US006666011B2

(12) United States Patent
Gnos et al.

(10) Patent No.: US 6,666,011 B2
(45) Date of Patent: Dec. 23, 2003

(54) SPINNING MACHINE WITH A CONDENSING DEVICE

(75) Inventors: Robert Gnos, Dinhard (CH); Jörg Theodor Wernli, Winterthur (CH); Thomas Schwab, Seuzach (CH)

(73) Assignee: Maschinenfabrik Rieter AG, Winterthur (CH)

( * ) Notice: Subject to any disclaimer, the term of this patent is extended or adjusted under 35 U.S.C. 154(b) by 99 days.

(21) Appl. No.: 09/930,561

(22) Filed: Aug. 15, 2001

(65) Prior Publication Data

US 2002/0134068 A1 Sep. 26, 2002

(30) Foreign Application Priority Data

Aug. 16, 2000 (DE) ..... 100 40 073

(51) Int. Cl.[7] ..... D01H 13/04; D01H 7/52
(52) U.S. Cl. ..... 57/315; 57/75
(58) Field of Search ..... 57/75, 315; 19/150, 19/236–250, 252, 286–288, 263, 304–308

(56) References Cited

U.S. PATENT DOCUMENTS 5,651,244 A * 7/1997 Lucca et al. ..... 57/75
6,032,451 A * 3/2000 Dinkelmann et al. ..... 57/315
6,131,383 A * 10/2000 Dinkelmann et al. ..... 57/315
6,318,060 B1 * 11/2001 Dinkelmann et al. ..... 57/3

FOREIGN PATENT DOCUMENTS

| | | | | |
|---|---|---|---|---|
| DE | 19805397 A1 * | 8/1999 | ..... | D01H/01/02 |
| DE | 19944444 A1 * | 3/2001 | ..... | D01H/01/02 |
| DE | 10030500 A1 * | 1/2002 | ..... | D01H/05/26 |
| DE | 10051413 A1 * | 3/2002 | ..... | D01H/05/26 |
| JP | 2002105768 A * | 4/2002 | ..... | D01H/01/22 |
| JP | 2002105776 A * | 4/2002 | ..... | D01H/05/72 |

* cited by examiner

*Primary Examiner*—John J. Calvert
*Assistant Examiner*—Shaun R Hurley
(74) *Attorney, Agent, or Firm*—Dority & Manning

(57) ABSTRACT

A spinning machine is provided. The spinning machine includes a drafting arrangement for drafting a fibre structure. The spinning machine also includes a spinning device for spinning the fibre structure, the spinning device is located downstream from the drafting arrangement. Also, a condensing device is located between the drafting arrangement and the spinning device. The condensing device has a stationary suction element in fluid communication with a condensing element. The condensing device and the suction element are configured to allow for the removal of air from the condensing element. The suction element has a housing and an insert. The insert is displaceable with respect to the housing along a guide. The insert is arrestable with respect to the housing.

14 Claims, 1 Drawing Sheet

SPINNING MACHINE WITH A CONDENSING DEVICE

BACKGROUND

The invention relates to a spinning machine according to the preamble of the independent claim, in particular a ring spinning machine with a condensing device disposed between a drafting arrangement and a spinning device.

Such arrangements are known for example from the publications of the patent applications with the numbers 19726694.0 and 19944444.7. The content of the said patent applications is to be regarded as an integral part of the present disclosure. Spinning machines of the kind mentioned above are included in the international patent classification D 01H-1/22.

It has been noticed that during the operation of spinning machines with condensing devices in particular, it is important that a simple accessibility of the individual members is also ensured during the spinning operation. It is further an object of the present invention to provide individual parts for condensing devices which can be produced inexpensively and are easy to mount.

SUMMARY OF THE INVENTION

Objects and advantages of the invention will be set forth in part in the following description or may be obvious from the description, or may be learned through practice of the invention.

One embodiment of the present invention provides for a spinning machine that has a drafting arrangement that is used for drafting a fibre structure. A spinning device is present for spinning the fibre structure and is located downstream from the drafting arrangement. A condensing device is also included and is located between the drafting arrangement and the spinning device. The condensing device has a stationary suction element that is in fluid communication with a condensing element. The condensing element and the suction element are configured to allow for the removal of air from the condensing element. The suction element has a housing and an insert, and the insert is displaceable with respect to the housing along a guide. Also, the insert is arrestable with respect to the housing.

The present invention also encompasses the spinning machine as previously discussed which further includes a lid that is attachable to the housing. The lid is also swiveable with respect to the housing, and the insert is lockable on the guide by the lid.

The present invention also includes an embodiment of a spinning machine as immediately discussed where the insert has a slot on an inlet side of the insert for airflow. The inlet has on an outlet side a first opening that is in alignment with a second opening on the lid when the lid is closed. The interior of the lid is configured as a conduit for guiding air.

Alternatively, the present invention includes an embodiment of a spinning machine as previously discussed where the inlet has a slot on an inlet side. Also, the housing has a tongue project therefrom and a side of the tongue faces the insert and is arranged congruently with a rear side of the insert towards the slot congruent with the tongue. In this configuration, the tongue forms the guide during the insertion of the insert into the housing.

Additionally, the present invention includes an embodiment of a spinning machine as previously discussed where the housing has on either side of the guide a first insert on one side and a second insert on an opposite side.

DETAILED DESCRIPTION

Figure 1:
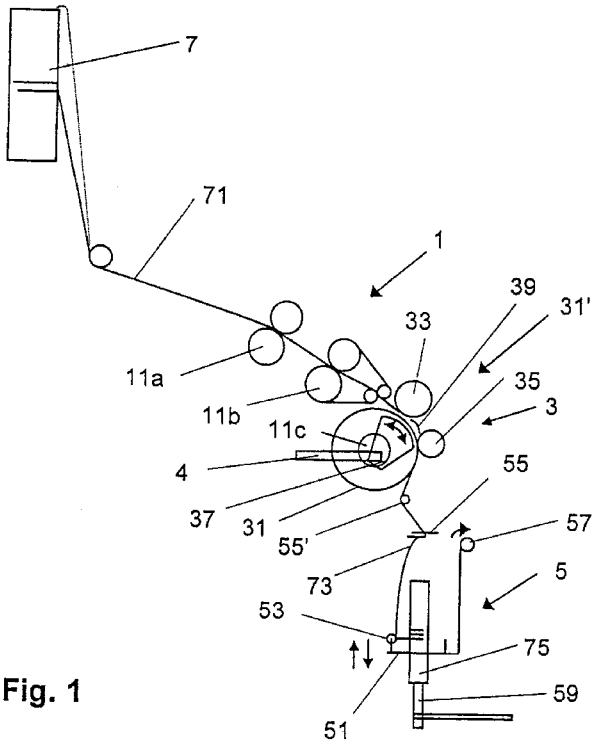
FIG. 1 schematically shows the view of a spinning place in the longitudinal direction of the spinning machine, shown by the way of an example of a ring spinning machine.

Reference will now be made in detail to embodiments of the invention, examples of which are shown in the drawings. Each example is provided by way of explanation of the invention, and not meant as a limitation of the invention. For example, features illustrated or described as part of one embodiment may be used on another embodiment to yield still a third embodiment. These and other modifications and variations are within the scope and spirit of the present invention.

The material feed 7 according to FIG. 1 consists in a convention spinning machine either of a can or a roving bobbin. A sliver 71 (shown with a broken line) is supplied from the can to the drafting arrangement 1. In the case of a roving bobbin the roving is drawn off from the circumference of the bobbin. The fibre structure, namely the roving or sliver, reaches the zone of the drafting arrangement 1 via a deflection apparatus. The drafting arrangement comprises several pairs of delivery rollers 11, preferably equipped in part with aprons. The sliver 71 is drafted weakly between the first and second pair of delivery rollers 11*a* and 11*b*, and then strongly drafted between the second and subsequent pair of rollers 31, 33. The draft ration can exceed in total the value of 100.

The drafted fibre structure is nipped between a nip roller 33 and a condensing element 31 and subsequently condensed on the condensing device 3. The fibre structure leaving the draft arrangement 1 is provided with a width which decreases during the condensing. A guide means 39, preferably in the form of a screen, can accompany the sliver on the surface of the condensing element 31 along the condensing zone 31'. Finally, a blocking roller 35 is disposed in the condensing zone 31', and is pressed against the condensing element 31 and thus limits the imparting of twist from a spinning device 5 against the direction of the material flow. A suction element 37 is disposed in the interior of the condensing element 31 and is connected to a suction device 4. The condensing element 31 is preferably a perforated rotating cylinder. The suction element 37 is provided with a suction opening in the zone of the perforation.

Thread guides 55, 55' are disposed between the drafting arrangement 1 and the spinning device 5. The thread guides 55 and 55', in the case of a ring spinning device, upwardly limit the balloon of thread 73 according to FIG. 1. In the lower zone of the spinning device, the thread 73 is wound up on a yarn package 75 by means of a traveller 53 on a ring which is fastened to a ring frame 51 as a result of the rotation of a spindle 59 having a drive. The height of the yarn package is defined by the range of movement of a ring frame drive 57 which reciprocates the ring frame 51 upwardly and downwardly in the vertical direction according to FIG. 1.

Figure 2:
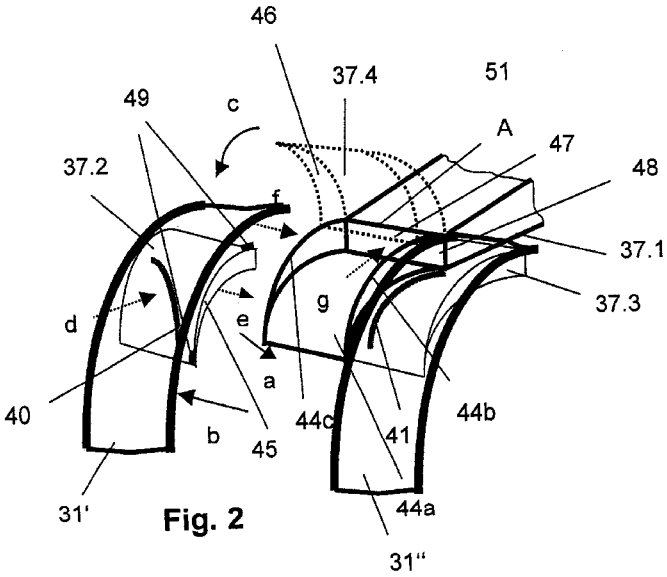
FIG. 2 shows a perspective representation the view of a part of a suction device.
Figure 3:
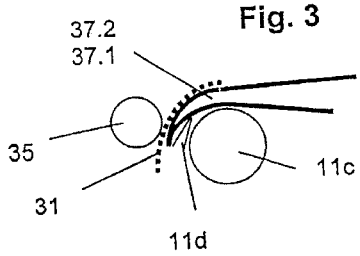
FIG. 3 shows a view of a suction housing with a part of a condensing element in the longitudinal direction of a spinning machine, with an adjacent nip roller.

The suction element 37 is schematically shown in detail in FIGS. 2 and 3. The suction element 37 consists of a housing 37.1 which is used as a conduit which transfers air to the suction device 4. In this manner, the air sucked in is discharged. Guide means 44*b*, 44*c* are attached to a tongue 44*a* in the front part of the housing 37.1. The guide means 44*b*, 44*c* are used to enable the holding of the inserts 37.2 and 37.3. The housing 37.1 with the attached guide means 44*b* and 44*c* could also be designed in such a way that the housing 37.1 carries only one insert 37.2. In this case the guide means 44*b* is not implement. The inserts 37.2 and 37.3 are inserted into the housing 37.1 when insert 37.2, which is shown n FIG. 2 in the unmounted state, is lowered according to arrow "a" between the guide means 44*b* and 44*c*. The insert 37.2 is then displaced parallel to an axis A outwardly through the guide means 44*c* in the direction of arrow "a".

Projections 49 on the side of the insert 37.2, which face the housing 37.1, prevent the insert 37.2 from being pushed so far through the guide means 44 that a defined position is lost. The projections 49 which rest laterally on the guide means 44 thus secure the position of the insert 37.2 relative to the housing 37.1 in combination with the guide means 44. The insert 37.3 can be positioned in an analogous manner thereto in that it is moved at first in the direction of arrow "a" against the tongue 44*a* until it rests on the tongue 44*a*. Thereafter the insert 37.3 is displaced to the right against the direction of arrow "b" through the intermediate space between the guide means 44*b* and the tongue 44*a* until the projections (not shown) rest on the guide means 44*b*. After the introduction of the inserts 37.2 and 37.3, a lid 37.4, which is swivellable about an axis A on the housing 37.1, is moved downwardly according to arrow "c" until the lower side of said lid 37.4 rests on the tongue 44*a*.

The lid 37.4 is open on a side which faces an insert 37.2 or 37.3 in order to receive the air from the insert 37.2 or 37.3. The air sucked in by the suction device 4 by means of a fan (not shown) passes at first through a suction slot 40 on the insert 37.1 or 41 on insert 37.3 into the interior of the respective insert 37.2 or 37.3. Flow occurs according to the direction of the arrow "d", and then according to the direction of arrow "e", "f" into the interior of the lid 37.4 which is used as a conduit. The air flowing into the insert 37.2 leaves through the side opening 45 and flows through the lid 37.4 or conduit 37.4 in order to then flow further according to the direction of arrow "g" through a third opening 48 into the housing 37.1. In the closed state of the lid 37.4, the first opening 45 is in alignment with the insert 37.2 and the second opening 46 is aligned with the conduit 37.4. Furthermore, a fourth opening 48 of housing 37.1 and a third opening 47 on the rear side of conduit 37.4 are in alignment when the lid 37.4 is closed.

The suction element 37 which consists of the individual parts of the housing 37.1, insert 37.2, and optionally a further insert 37.3 and the lid 37.4, can be brought to the machine in its entirety or individual parts. It is also possible to exchange only the inserts 37.2 and 37.3 according to the material to be processed. The slots 40 and 41 in the inserts 37.2 and 37.3 can be provided with a different design concerning shape and width of the slots 40 and 41 depending on the fibre material on the spinning machine. This is done so that changing of the spinning machine from one material to another allows a user to select an optimal slot shape.

FIG. 2 shows the condensing elements 31' and 31". Condensing elements 31' and 31" can be cylindrical or non-cylindrical, a solid or a flexible cylinder. Further it can be a narrow ribbon or a strip of fabric. A perforation is provided in the condensing elements at least in the part of the condensing elements which is disposed above the suction slot 40, 41 in order to allow the passage of air into the suction slot. Also the air may be applied to the fibre structure 71 and guided over the condensing elements in the zone of slots 40 and 41 according to FIG. 1. It is understood that condensing element 31" may be disposed above the other insert 37.2 in the mounted state of housing 37.2 in another embodiment of the invention. This is also shown in FIG. 3 where only a part of a condensing element 31 is shown in alignment with the housing 37.1. If the condensing element 31, as is schematically shown in FIG. 1, is arranged concentrically with a roller 11*c* and is torsionally rigidly connected with the same, it is appropriate for the housing 37.1 to rest on the roller 11*c*. The support can be made directly or by way of a spring 11*d*. The latter ensures a play-free contact of an insert 37.3 or 37.2 on the respectively associated condensing element 31' or 31". If the condensing element 31' or 31" is an apron or a narrow ribbon the condensing element does not have to be connected in a torsionally rigid manner with the roller 11*c*. In this case, it is provided with a supporting function for the housing 37.1. In the zone of the insert 37.2 or 37.1 a blocking roller 35 can rest on the condensing element. This roller can also be used to drive the condensing element in the conveying direction of the sliver 71. By arranging the condensing elements 31 adjacent to the housing 37.1, it is possible to perform the mounting both of housing 37.1 as well as the inserts 37.2 and 37.3 during the operation of the spinning machine. The condensing element is moved relative to the housing and the insert 37.1 and 37.2 and 37.3 during operation of the spinning machine. In contrast to the inserts, 37.2 and 37.3 shown in FIG. 2 in arc shape with mutually converging inner and outer contours, it is possible to provide an embodiment in which the inner and outer contours substantially lie on concentric circles. If the condensing element 31' or 31" is guided in the zone of the insert 37.2, 37.3 in one plane it is necessary that the side of the insert 37.2 or 37.3 with slot 40 or 41 is also provided with a plane arrangement so that the slot 40 lies directly under the perforation of the respective condensing element.

It should be understood that the invention includes various modifications that can be made to the embodiments of the spinning machine described herein as come within the scope of the appended claims and their equivalents.

What is claimed is:

1. A spinning machine comprising:

a drafting arrangement for drafting a fibre structure;

a spinning device for spinning the fibre structure located downstream from said drafting arrangement; and a condensing device located between said drafting arrangement and said spinning device, said condensing device having a stationary suction element in fluid communication with a condensing element, said condensing element and said suction element configured to allow for the removal of air from said condensing element, wherein said suction element has a housing and an insert, said insert displaceable with respect to said housing along a guide, said insert secured in position relative to said housing by way of projections cooperating with said guide.

2. The spinning machine of claim 1, further comprising a lid attachable to said housing and swiveable with respect to said housing, said insert being lockable on said guide by said lid.

3. The spinning machine of claim 2, wherein said insert and said lid are disposed behind one another in the longitudinal direction of said spinning machine when said lid is closed with respect to said housing.

4. The spinning machine of claim 2, wherein said insert has a slot on an inlet side of said insert for air flow and said insert has on an outlet side of said insert a first opening which is in alignment with a second opening on said lid when said lid is closed, the interior of said lid being configured as a conduit for guiding air.

5. The spinning machine of claim 4, wherein said lid has an outlet side and a third opening disposed on said outlet side of said lid, said housing has a fourth opening and said third opening is aligned with said fourth opening for allowing air to be discharged from the interior of said lid to the interior of said housing.

6. The spinning machine of claim 2, wherein said insert is positioned with respect to said housing by an edge zone of a tongue on said housing, said and an edge zone of said lid.

7. The spinning machine of claim 1, wherein said projections rest on said guide during engagement of said insert and said housing.

8. The spinning machine of claim 1, wherein said insert has a slot on an inlet side of said insert, and wherein said condensing element is configured so that said condensing element is movably guided on the inlet side of said insert.

9. The spinning machine of claim 1, wherein said insert has a slot on an inlet side of said insert, and wherein said condensing element has perforations allowing for fluid communication with said slot of said insert, and said condensing element is selected from the group consisting of a rigid circular cylinder, a flexible endless apron, and a narrow ribbon.

10. The spinning machine of claim 1, wherein said housing rests on a roller and said housing is stationary with respect to said spinning machine.

11. The spinning machine of claim 1, further comprising a spring configured for urging said insert in said housing against said condensing element.

12. The spinning machine of claim 1, further comprising a blocking roller that rests on said condensing element, said condensing element is guided between said insert and said locking roller.

13. The spinning machine of claim 1, wherein said insert has a slot on an inlet side of said insert, and wherein said housing has a tongue projecting from said housing, a side of said tongue faces said insert and is arranged congruently with a rear side of said insert towards said slot congruent with said tongue so that said tongue forms said guide during the insertion of said insert into said housing.

14. The spinning machine of claim 1, wherein said housing has on either side of said guide a first insert on one side and a second insert on an opposite side.

* * * * *